US005980722A

United States Patent [19]

Kuroda et al.

[11] Patent Number: 5,980,722

[45] Date of Patent: Nov. 9, 1999

[54] PLATED ALUMINUM ALLOY, CYLINDER BLOCK THEREOF, PLATING LINE AND PLATING METHOD

[75] Inventors: Tetsuya Kuroda; Hidezumi Katoh; Hitoshi Muramatsu, all of Shizuoka-ken, Japan

[73] Assignee: Suzuki Motor Corporation, Shizuoka-ken, Japan

[21] Appl. No.: 08/960,511

[22] Filed: Oct. 29, 1997

[30] Foreign Application Priority Data

| | | | |
|---|---|---|---|
| Oct. 30, 1996 | [JP] | Japan | 8-303993 |
| Dec. 17, 1996 | [JP] | Japan | 8-336594 |
| Dec. 20, 1996 | [JP] | Japan | 8-341264 |
| Apr. 16, 1997 | [JP] | Japan | 9-114315 |
| Aug. 12, 1997 | [JP] | Japan | 9-230243 |

[51] Int. Cl.[6] ..... C25D 5/34

[52] U.S. Cl. ..... 205/219; 205/640

[58] Field of Search ..... 205/205, 213, 205/219, 172, 183, 271, 272, 324, 328

[56] References Cited

U.S. PATENT DOCUMENTS

| | | | |
|---|---|---|---|
| 4,225,399 | 9/1980 | Tomita | 204/58 |
| 4,566,952 | 1/1986 | Sprintschnik et al. | 204/27 |
| 4,584,067 | 4/1986 | Hutchins et al. | 204/33 |
| 4,608,131 | 8/1986 | Brenk | 204/33 |
| 5,643,434 | 7/1997 | Benmalek et al. | 205/109 |
| 5,647,967 | 7/1997 | Murase et al. | 205/131 |
| 5,660,704 | 8/1997 | Murase | 205/109 |
| 5,775,892 | 7/1998 | Miyasaka et al. | 418/55.2 |

FOREIGN PATENT DOCUMENTS

| | | |
|---|---|---|
| 62-297492 | 12/1987 | Japan . |
| 03191095 | 8/1991 | Japan . |

*Primary Examiner*—Donald R. Valentine
*Assistant Examiner*—Erica Smith-Hicks
*Attorney, Agent, or Firm*—Myers Bigel Sibley & Sajovec

[57] ABSTRACT

A method of plating an aluminum alloy, of which the steps are small in number and the productivity is improved as compared with conventional zincate conversion or anodic oxidation methods and which attains a decrease in cost and obviates the use of mixed acids, and a plated aluminum alloy of which the coating has excellent adhesion, the method comprising the steps of carrying out anodic etching of a silicon-containing aluminum alloy to protrude silicon from the surface of the aluminum alloy, optionally carrying out anodic oxidation of the aluminum alloy on its surface from which the silicon is protruded, and plating the aluminum alloy, and the plated aluminum alloy containing silicon in a state where the silicon bridges the aluminum alloy and the plating layer.

16 Claims, 7 Drawing Sheets

X400

X400

PLATED ALUMINUM ALLOY, CYLINDER BLOCK THEREOF, PLATING LINE AND PLATING METHOD

FIELD OF THE INVENTION AND RELATED ART STATEMENT

The present invention relates to a plated aluminum alloy containing silicon (ADC material, AC material and elongation material), a cylinder block for which the above aluminum alloy is applied, a method of pretreatment for plating, a plating method and a plating line. The present invention is applied to the plating of parts for a two-wheeled vehicle and a four-wheeled vehicle, such as the plating of a cylinder interior wall surface of a cylinder block, a piston, a clutch, etc., made of an aluminum alloy casting. The piston and a clutch cover are not honed.

Conventionally, a double zincate conversion method (double zincate method) is known as a general method for plating an aluminum alloy. This method is currently the most widely industrially employed, and it includes 15 steps as shown in Table 1, such as the steps of neutrally degreasing, washing with water, degreasing with an alkali, washing with water, alkali etching, washing with water, treatment with mixed acids, washing with water, zincate conversion, washing with water, immersion in an acid, washing with water and plating. The above method gives excellent adhesion since zinc conversion is carried out twice. Since, however, it includes 14 steps as pretreatment steps, the pretreatment requires a long period of time and the steps are complicated. As a result, the method has the following problems. It is not sufficiently-reliable, it is difficult to control the line thereof, the cost is high and the controlling of treating liquids is complicated.

Further, the handling of the mixed acids (nitric acid and hydrofluoric acid) used in the pretreatment step is very difficult, it is required to use acid-resistant tools and equipment, and it is required to take care for safety. For example, when a cylinder block is plated by a flow method, it is required to seal a chucking surface. When the treatment steps increase in number, the sealing treatment increases in number, and the risk of causing defective sealing accordingly increases. In particular, the mixed acids are liable to corrode a sealing material and cause the leakage of the liquid, and it is therefore required to be careful about the handling thereof.

In addition to the zincate conversion method using zinc (Zn), there has been developed a multi-element conversion method using Fe, Cu, Ni or the like in addition to zinc.

TABLE 1

| Zincate conversion method | Anodic oxidation method |
|---|---|
| Neutral degreasing NG-30 (supplied by KIZAI Co.), 45° C., 10 minutes | the same as the left |
| Washing with water | the same as the left |
| Degreasing with an aikaii SZ cleaner (supplied by KIZAI Co.), 70° C., 5 minutes | the same as the left |
| Washing with water | the same as the left |
| Alkali etching ($P_3T_{651}$-7)(supplied by HENKEL HAKUSUISHA Co.) 65° C., 2 minutes | the same as the left |
| Washing with water | the same as the left |
| Treatment with mixed acids $HNO_3$:HF = 9:1, room temperature, | the same as the left |

TABLE 1-continued

| Zincate conversion method | Anodic oxidation method |
|---|---|
| 30 seconds | |
| Washing with water | the same as the left |
| Zincate conversion SZ-II (supplied by KIZAI Co.), 20° C., 30 seconds | Anodic oxidation treatment |
| Washing with water | Phosphoric acid 350 g/L |
| Immersion in acid (nitric acid), room temperature, 15 seconds | Temperature 33° C. Current density 1.2 A/dm$^2$ |
| Washing with water | |
| Zincate conversion SZ-II (supplied by KIZAI Co.), 20° C., 30 seconds | Time 15 minutes |
| Washing with water | the same as the left |
| Plating | the same as the left |

Further, an anodic oxidation method (anodic oxide coating method) is also known. In this method, an aluminum alloy is anodized to form a porous oxide coating, and the oxide coating is used as an anchor for plating. As shown in Table 1, the method includes 11 steps, such as the steps of neutral degreasing, washing with water, alkali degreasing, washing with water, alkali etching, washing with water, treatment with mixed acids, washing with water, anodic oxidation, washing with water and plating. The method includes a number of steps, and the defect thereof is that its anchor effect is low since large concavo-convex shape cannot be formed. Further, since an intermediate layer formed of an anodic oxide coating is present between an aluminum alloy and a coating formed by plating, there is a high risk of incurring incomplete adhesion. Further, the method also has another defect that when the content of impurities (Si, etc.,) in the aluminum alloy is large, the adhesion is poor so that the method is not sufficiently reliable.

With regard to the anodic oxidation method, there has been proposed a method in which the number of the steps is decreased by omitting the step of treatment with mixed acids, as disclosed in Japanese Patent Provisional Publication No. 3-191095/'91. However, when the treatment with mixed acids is omitted, a smut caused by alkali etching is not removed, and when plating is directly carried out, the smut remains in the interface between an aluminum alloy material and a coating formed by the plating. There is therefore a defect that the adhesion is poor.

Meanwhile, a plating-coated aluminum alloy obtained by the anodic oxidation method has a cross section as schematically shown in FIG. 10. As shown in FIG. 10, an anodic oxide coating 92 is formed in the form of a layer between a plating-formed coating 91 (plating layer) and a silicon-containing aluminum alloy 93. It is therefore difficult to produce an anchor effect between the plating-formed coating 91 and the aluminum alloy 93, and the adhesion is consequently poor.

Further, an inversion electrolytic activation method is also known as disclosed in Japanese Patent Publication No. 2-40751/'90. In this method, an aluminum alloy is immersed in an electrolyte, and positive voltage and negative voltage are alternately applied to activate the aluminum alloy surface. Since, however, the method requires a special power source for positively and negatively inverting the applied voltage and controlling the inversion ratio as required, the equipment cost increases.

SUMMARY OF THE INVENTION

It is an object of the present invention to provide a method of pretreatment of an aluminum alloy for plating it and a method of plating the aluminum alloy, of which the steps are small in number and simple as compared with a prior art zincate conversion method and an anodic oxidation method and which attain high adhesion, a plated aluminum alloy, and a cylinder block to which these are applied.

The plated aluminum alloy of the present invention comprises a silicon-containing aluminum alloy, a plating layer formed on the surface of the aluminum alloy and silicon present in a state where the silicon bridges the aluminum alloy and the plating layer.

Further, the plated aluminum alloy of the present invention permits the formation of a concavo-convex shape in the interface between the above aluminum alloy and the above plating layer.

Further, the plated aluminum alloy of the present invention may contain an aluminum alloy oxide layer between the above aluminum alloy and the above plating layer.

The plated aluminum alloy of the present invention is preferably used, e.g., as a cylinder block.

The method of pretreatment of an aluminum alloy for plating it, provided by the present invention, comprises the step of carrying out anodic electrolytic etching of a silicon-containing aluminum alloy to protrude the silicon from the surface of the aluminum alloy.

In the method of pretreatment of an aluminum alloy for plating it, provided by the present invention, a concavo-convex shape can be formed on the surface of the above aluminum alloy.

In the method of pretreatment of an aluminum alloy for plating it, provided by the present invention, the above anodic electrolytic etching can be carried out by using the silicon-containing aluminum alloy as an anode, using an insoluble electrode as a cathode and applying electricity in an electrolyte.

The method of plating an aluminum alloy, provided by the present invention, comprises the steps of carrying out anodic electrolytic etching of a silicon-containing aluminum alloy to protrude silicon from the aluminum alloy surface and plating the aluminum alloy.

In the method of plating an aluminum alloy, provided by the present invention, further, a concavo-convex shape can be formed on the aluminum alloy surface by the above anodic electrolytic etching.

The method of plating an aluminum alloy, provided by the present invention, may further comprise the step of anodizing the silicon-protruding surface of the aluminum alloy before the above plating step.

In the method of plating an aluminum alloy, provided by the present invention, the above anodic electrolytic etching can be carried out by using the silicon-containing aluminum alloy as an anode, using an insoluble electrode as a cathode and applying electricity in an electrolyte.

The above electrolyte can be selected from phosphoric acid, sulfuric acid, sulfamic acid and the like.

The line for plating an aluminum alloy, provided by the present invention, comprises degreasing portion, an electrolytic etching portion and a plating portion.

The line for plating an aluminum alloy, provided by the present invention, may further comprises an anodizing portion.

According to the present invention, the number of steps is small, the time required for treatments is small, the production efficiency is improved, apparatus and equipment can be downsized, and the cost can be decreased, as compared with the conventional zincate conversion method and the conventional anodic oxidation method. The present invention further obviates the mixed acids of which the handling is difficult.

Further, according to the present invention, a plating layer having excellent adhesion can be formed on an aluminum alloy having a high silicon content.

Further, since ADC12, etc., of aluminum alloys are difficult to pre-treat for plating them, conventionally, a cast iron sleeve is inserted into an ADC 12 cylinder under pressure or by casting. In contrast, the present invention no longer requires the cast iron sleeve and makes a contribution to a decrease in weight and an improvement in cooling properties.

DETAILED DESCRIPTION OF PREFERRED EMBODIMENTS

The aluminum alloy used in the present invention includes, for example, an ADC material, AC material and elongation material). Specific examples of the aluminum alloy include AC4C, AC4B, AC4D, AC8A, ADC10 and ADC12 which are names according to JIS Standard.

In particular, a die cast aluminum alloy (ADC12 or the like) is produced by die casting and therefore shows a high cooling rate on a surface portion as compared with an aluminum casting produced with a sand mold. As a consequence, the surface portion of the above die casting has a chilled layer having a high silicon density and fine crystal grains. The die cast aluminum alloy therefore has a larger content of silicon which is protruded on the surface by anodic electrolytic etching, as compared with an aluminum casting having the same alloy composition (mainly, the same silicon content), and the shape thereof is also complicated and fine. When plating is effected on an aluminum alloy treated by anodic electrolytic etching, a plating material penetrates gaps of silicon crystal and there can be obtained a very high anchor effect.

The method of the present invention can be carried out, for example, in the order of degreasing, washing with water, anodic electrolytic etching, washing with water and plating, as shown in Table 2.

TABLE 2

| |
|---|
| Degreasing |
| Washing with water |
| Anodic electrolytic etching |
| Washing with water |
| Plating |

The degreasing is carried out with a degreasing agent such as NG30 (supplied by KIZAI Co.) at a temperature of 40 to 50° C. for 5 to 15 minutes.

Figure 1A:
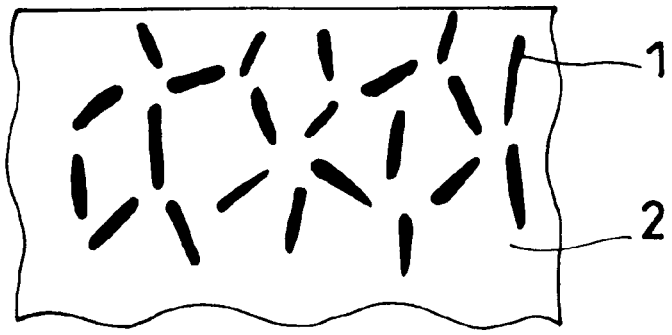
FIGS. 1(A)–(C) shows the steps of the plating method of the present invention.
Figure 1B:
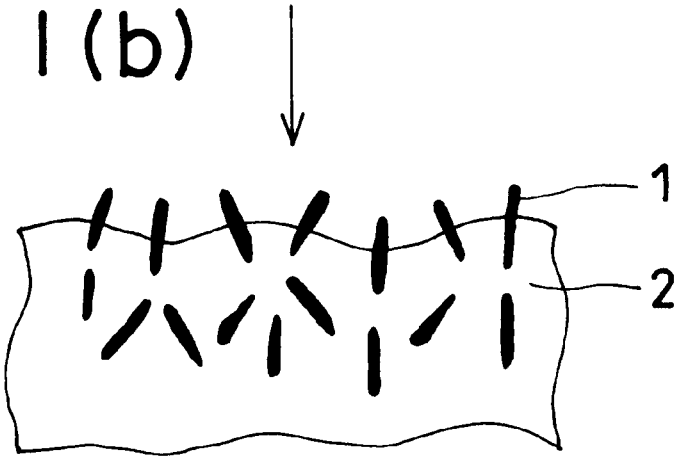
Figure 1C:
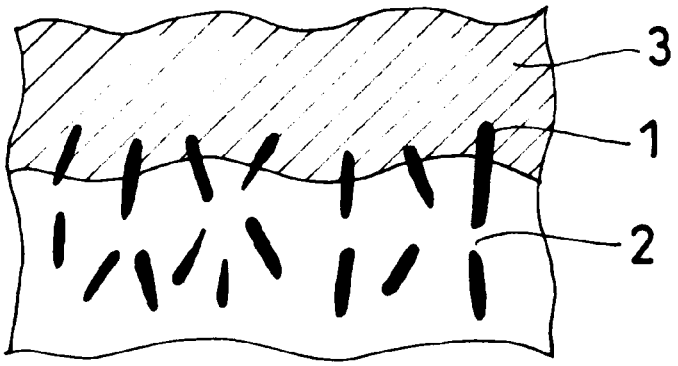

The anodic electrolytic etching is carried out by immersing a silicon-containing aluminum alloy in an electrolyte, using the aluminum alloy as an anode and using an insoluble electrode as a cathode. In this treatment, aluminum component of the silicon-containing aluminum alloy is dissolved, silicon protrudes on the aluminum alloy surface and a concavo-convex shape is formed on the aluminum alloy surface. FIG. 1 shows this method. In FIG. 1, (a) shows a state before the electrolytic etching. Silicon 1 is contained in an aluminum alloy 2. (b) shows a state after the electrolytic etching. (c) shows a state after plating. Silicon 1 is present in a state where it bridges the aluminum alloy 2 and a plating-formed coating (plating layer) 3.

The above electrolyte can be selected from phosphoric acid, sulfuric acid, sulfamic acid and the like.

When phosphoric acid is used as an electrolyte, the electrolytic etching is carried out in a phosphoric acid concentration of 40 to 900 g/L at a temperature of 50 to 100° C. at an anode current density of 20 to 400 A/dm$^2$. When the above concentration is less than 40 g/L, aluminum is not dissolved, silicon does not sufficiently precipitate, and no sufficient anchor effect can be obtained. As a result, the adhesion is poor. When the above concentration exceeds 900 g/L, it is difficult to dispose of or handle a waste liquid. When the above temperature is lower than 50° C., an anodic oxide coating is formed on the aluminum surface, so that aluminum is not dissolved and that silicon does not sufficiently precipitate. As a result, no sufficient anchor effect is obtained, and the adhesion of a plating layer is poor. When the above temperature exceeds 100° C., undesirably, a large amount of the electrolyte evaporates, and it is therefore required to re-feed the electrolyte frequently. When the anode current density is less than 20 A/dm$^2$, no etching effect is produced, and the adhesion of a plating layer is poor. When the anode current density exceeds 400 A/dm$^2$, undesirably, a large amount of heat is generated, and a cooling apparatus is required.

When sulfamic acid is used as an electrolyte, the electrolytic etching is carried out in a sulfamic acid concentration of 75 to 600 g/L at a temperature of 65 to 100° C. at an anode current density of 50 to 300 A/dm$^2$. When the above concentration is less than 75 g/L, aluminum is not dissolved. Therefore, silicon does not precipitate, no sufficient anchor effect is obtained, and the adhesion of a plating layer is poor. When the concentration exceeds 600 g/L, undesirably, sulfamic acid is not dissolved and is brought into a state where it is saturated. When the temperature is lower than 65° C., aluminum is not dissolved, and silicon does not sufficiently precipitate. Therefore, no sufficient anchor effect is obtained, and the adhesion of a plating layer is poor. When the temperature exceeds 100° C., undesirably, a large amount of evaporation is generated, and it is required to re-feed the electrolyte frequently. When the anode current density is less than 50 A/dm$^2$, aluminum is not dissolved, and the anchor effect produced by the precipitation of silicon is not obtained. When the anode current density exceeds 300 A/dm$^3$, undesirably, a large amount of heat is generated, and a cooling apparatus is required.

When nickel sulfamate is used as a plating liquid, the washing with water after the pretreatment is unnecessary, and the step therefore can be omitted.

When sulfuric acid is used as an electrolyte, the electrolytic etching is carried out in a sulfuric acid concentration of 75 to 600 g/L at a temperature of 50 to 100° C. at an anode current density of 50 to 200 A/dm$^2$. When the concentration is less than 75 g/L, an anodic oxide coating is formed on the aluminum surface, aluminum is not dissolved, the anchor effect produced by the precipitation of silicon is not obtained, and the adhesion of a plating layer is poor. When the concentration exceeds 600 g/L, undesirably, it is difficult to dispose of or handle a waste liquid. When the temperature is lower than 50° C., an anodic oxide coating is formed on the aluminum surface, aluminum is not dissolved, the anchor effect produced by the precipitation of silicon is not obtained, and the adhesion of a plating layer is poor. When the temperature exceeds 100° C., undesirably, a large amount of evaporation is generated, and it is required to re-feed the electrolyte frequently. When the anode current density is less than 50 A/dm$^2$, aluminum is not dissolved, no anchor effect is obtained, and the adhesion of a plating layer is poor. When the anode current density exceeds 200 A/dm$^2$, undesirably, a large amount of heat is generated, and a cooling apparatus is required.

When a mixture of phosphoric acid and sulfuric acid is used as an electrolyte, the electrolytic etching is carried out in a phosphoric acid concentration of 0 to 900 g/L and a sulfuric acid concentration of 0 to 600 g/L, at a temperature of 50 to 100° C. at an anode current density of 50 to 300 A/dm$^2$. The mixing ratio of phosphoric acid and sulfuric acid is not specially limited. However, for example, when the proportion of sulfuric acid is very small, the phosphoric acid concentration is required to be at least about 40 g/L.

The reason for the above limitation of the temperature range and the reason for the above numerical limitation of the anode current density are the same as those in the above case where phosphoric acid alone or sulfuric acid alone is used.

The use of the mixture of phosphoric acid and sulfuric acid has the following advantages. That is, when phosphoric acid alone is used, heat is easily generated due to a high electric resistance, and it is difficult to control the temperature. When sulfuric acid alone is used, the electric resistance is low, while an anodic oxide coating is liable to be formed. When the mixture of phosphoric acid and sulfuric acid is used, the electric resistance is low so that the amount of heat to be generated is decreased, and it is easy to control the liquid temperature, as compared with the case where phosphoric acid alone is used. Further, no anodic oxide coating is formed, the dissolution of aluminum is promoted, the anchor effect produced by the precipitation of silicon is easily obtained, and the adhesion of a plating layer is improved.

The electrolysis time is 2 to 15 minutes (generally approximately 2 to 5 minutes) when any one of the above electrolytes is used.

The insoluble electrode includes, for example, electrodes formed of SUS (SUS304, etc.), Pt, Ti and Ti plated with Pt.

The plating material includes Ni-P-SiC, Ni-P, Ni-SiC, hard chromium, etc. When a cylinder block is plated, particularly preferred are a plating-formed coating of Ni-P in which phosphoric acid is added, and a plating-formed coating of Ni-SiC or Ni-P-SiC in which SiC is dispersed in view of the prevention of abrasion.

The plating is generally carried out in a plating bath having a pH of 3.5 to 4.5 and having a temperature of 55 to 60° C. by applying electricity at a current density of 5 to 20 $A/dm^2$ for 20 to 60 minutes.

When an aluminum alloy is plated after the anodic electrolytic etching, a plating-formed coating (plating layer) having excellent adhesion can be obtained on the basis of the anchor effect produced by both the protrusion of silicon and the formation of a concavo-convex shape on the aluminum alloy surface.

In the method of the present invention, preferably, silicon has a fine concavo-convex shape and the concentration of silicon in the aluminum alloy is high.

Specifically, per $10^4$ $\mu m^2$ of cross section of the aluminum alloy, the average value of total sum of peripheral lengths of silicon is preferably at least 500 $\mu$m.

Further, the silicon content of the aluminum alloy containing silicon is preferably at least 4.5% by weight.

As far as the above point is concerned, it is preferred in the conventional zincate conversion method that the silicon concentration should be low. In the zincate conversion method, a smut composed mainly of silicon occurs due to alkali etching and remains on a surface, and it is therefore required to remove the smut in the subsequent step of treatment with mixed acids. When, however, smut cannot be removed and remains, the smut may cause an incomplete adhesion. In the zincate conversion method, therefore, it is preferred to use an aluminum alloy having a composition which causes no occurrence of a smut, i.e., an aluminum alloy having a smaller silicon content. Further, since silicon shows low activity in the zincate conversion, zinc particles are hardly precipitated, which is liable to cause an incomplete adhesion.

In the conventional anodic oxidation method, it is preferred as well that the silicon concentration in an aluminum alloy should be low. That is because, since silicon has low electrical conductivity, silicon does not easily conduct electricity, and an anodic oxide coating is not easily formed in a site where silicon is present.

In the plating method of the present invention, an aluminum alloy portion other than a silicon crystal can be converted to a porous portion by forming an anodic oxide coating on the aluminum alloy portion of a work surface other than a silicon crystal after the anodic electrolytic etching is carried out.

When the plating is carried out after the anodic oxidation, a plating-formed coating having high adhesion can be formed on the basis of bridging silicon, the concavo-convex shape of a work and the above-formed porosity. Owing to these, excellent adhesion can be achieved with regard to an aluminum alloy having any silicon concentration.

The anodic oxidation treatment can use the same tools, apparatus, equipment and electrolyte as those used in the anodic electrolytic etching.

Figure 2:
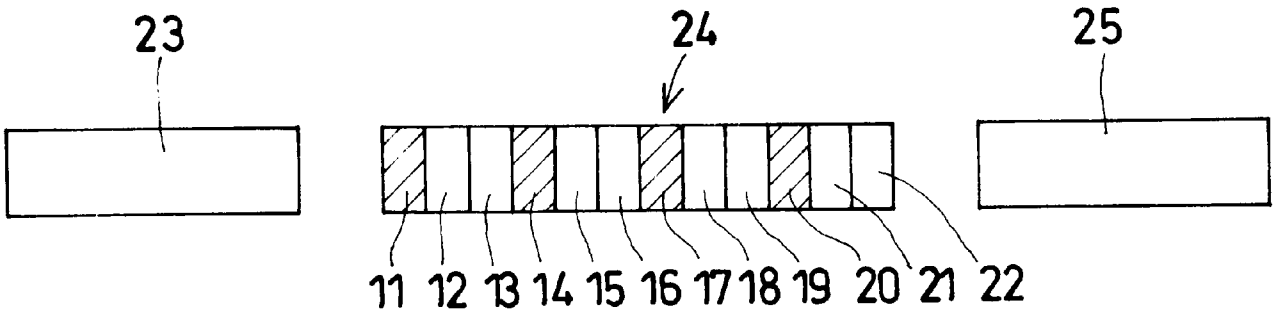
FIG. 2 shows one embodiment of a cylinder fabrication line according to the plating method of the present invention.

The production line for 4-cycle cylinders of an aluminum alloy, the pretreatment steps of which are at least three steps of degreasing, electrolytic etching and anodic oxidation, will be explained with reference to FIG. 2. FIG. 2 includes a cylinder machining line 23, a plating line 24 and a cylinder honing line 25. A 4-cycle cylinder made of an aluminum alloy is machined in the cylinder machining line 23, and then transferred to the plating line 24. In the plating line, first, oil component such as a cutting oil is removed in a degreasing vessel 11, and the cylinder is washed with water in washing-with-water vessels 12 and 13, and then transferred to an electrolytic etching vessel 14. After the electrolytic etching, the cylinder is washed with water in washing-with-water vessels 15 and 16, and then transferred to an anodic oxidation vessel 17. After the anodic oxidation, the cylinder is washed with water in washing-with-water vessels 18 and 19, plated in a plating vessel 20, and further washed with water in washing-with-water vessels 21 and 22. Thereafter, the cylinder is honed in the cylinder honing line 25.

A combination of the degreasing vessel 11 and the washing-with-water vessels 12 and 13 is referred to as a degreasing portion, a combination of the electrolytic etching vessel 14 and the washing-with-water vessels 15 and 16 is referred to as an anodic electrolytic etching portion, a combination of the anodic oxidation vessel 17 and the washing-with-water vessels 18 and 19 is referred to as an anodic oxidation portion, and a combination of the plating vessel 20 and the washing-with-water vessels 21 and 22 is referred to as a plating portion.

In the line, the method of conveying an aluminum alloy casting (work) is not specially limited, and any method may be employed. For example, the work can be conveyed with a work chuck holding the work and moving on the line along a rail.

In the present invention, the anodic oxidation portion may be omitted.

The anodic oxidation treatment is carried out in the presence of phosphoric acid, sulfuric acid or oxalic acid as an electrolyte. Of these, phosphoric acid is preferred. When phosphoric acid is used as an electrolyte, the anodic oxidation treatment is carried out in a phosphoric acid concentration of 50 to 500 g/L, at a temperature of 10 to 60° C., at a current density of 2 to 30 $A/dm^2$ for 2 to 15 minutes (generally for 2 to 5 minutes).

When both the electrolytic etching treatment and the anodic oxidation treatment use phosphoric acid as an electrolyte, the step of washing with water after the electrolytic etching treatment can be omitted, the line is decreased in the number of steps and the productivity is therefore improved.

Figure 3:
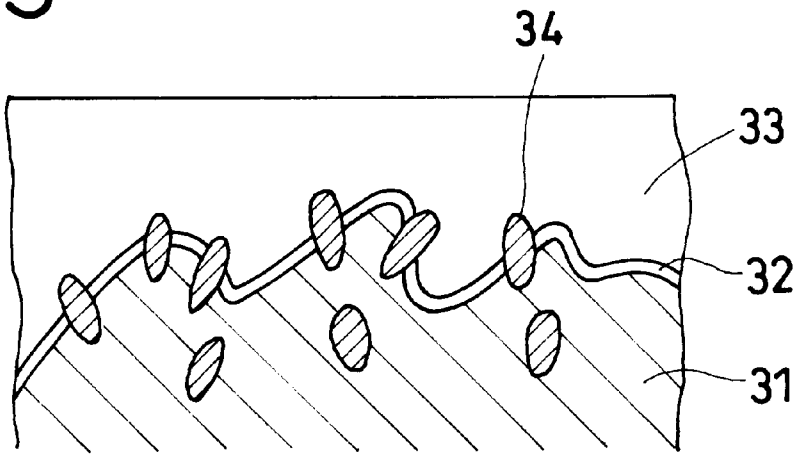
FIG. 3 is a schematic view of cross section of a plating-coated aluminum alloy obtained according to the method of the present invention.

FIG. 3 is a schematic view of cross section of a plating-coated aluminum alloy obtained by the method of the present invention including the anodic oxidation step. In FIG. 3, an oxide layer 32 of an aluminum alloy is present between an aluminum alloy 31 and a plating layer 33. Silicon 34 protruding from the aluminum alloy provides an anchor effect for the plating layer 33.

Figure 4:
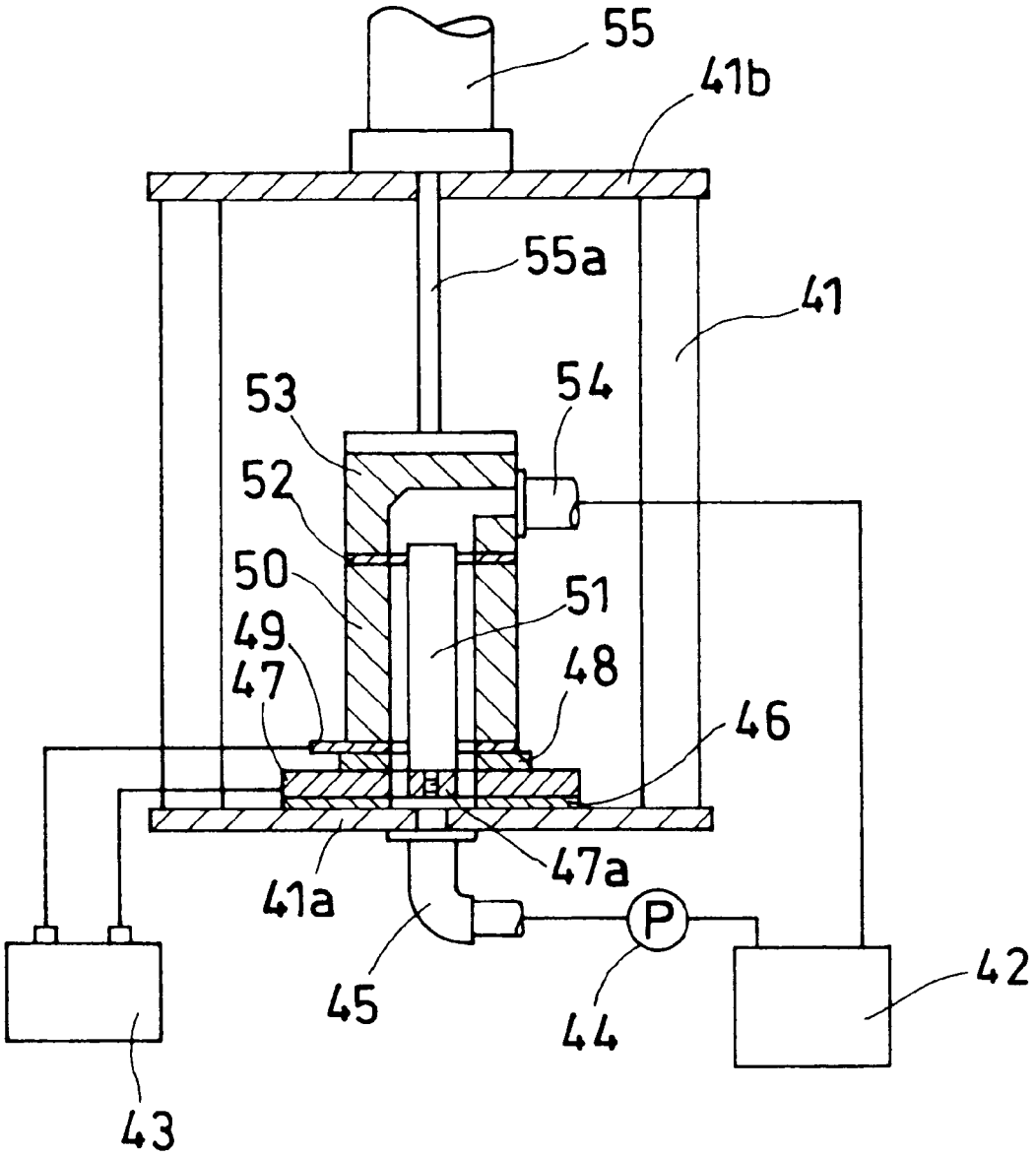
FIG. 4 shows one example of an apparatus for anodic electrolytic etching.

FIG. 4 shows one example of an apparatus for carrying out the electrolytic etching of a cylinder. In FIG. 4, a frame 41 has a lower frame member 41*a* and an upper frame member 41*b*, and disposed on the lower frame member 41*a* are an insulation plate 46, an electrode plate 47, an insulation plate 48, an electrode plate 49, a cylinder (work) 50, a packing 52 and an upper tool 53. In the center of each of these members, each of these members has a hole whose diameter is the same as that of the cylinder. These members are disposed such that their centers are on one axial line to form a path for flowing a liquid. Further, these members are pressed downwardly with an air cylinder 55 through a press rod 55*a* to be fixed. An electrolyte is sent from a liquid vessel 42 under pressure with a pump 44, flows in through a liquid inlet portion 45 disposed on the lower side of the lower frame member 41*a,* passes through the interior of the cylinder and is discharged to the liquid vessel 42 through a liquid outlet portion 54 disposed on the upper tool 53. The center of hole portion of the electrode plate 47 is provided with an electrode support 47*a,* and an electrode 51 of an insoluble electrode (a rod made of stainless steel) is supported on, and fixed to, the electrode support 47*a* such that the electrode 51 is positioned in the center of the path for the electrolyte. Generally, the electrode plate 47 is used as minus and the electrode plate 49 is used as plus such that the electrode 51 is minus and that the cylinder (work) 50 is plus, and electricity is applied from a power source 43.

When the electrolytic etching is carried out by flowing the electrolyte through only the interior of the cylinder as described above, no unnecessary portion is etched, and no troublesome masking is required, so that the electrolytic etching is efficiently carried out. Further, the anodic oxidation treatment can be carried out by means of an apparatus having almost the same structure as that of the apparatus used for the electrolytic etching except for a different treatment liquid.

Figure 5:
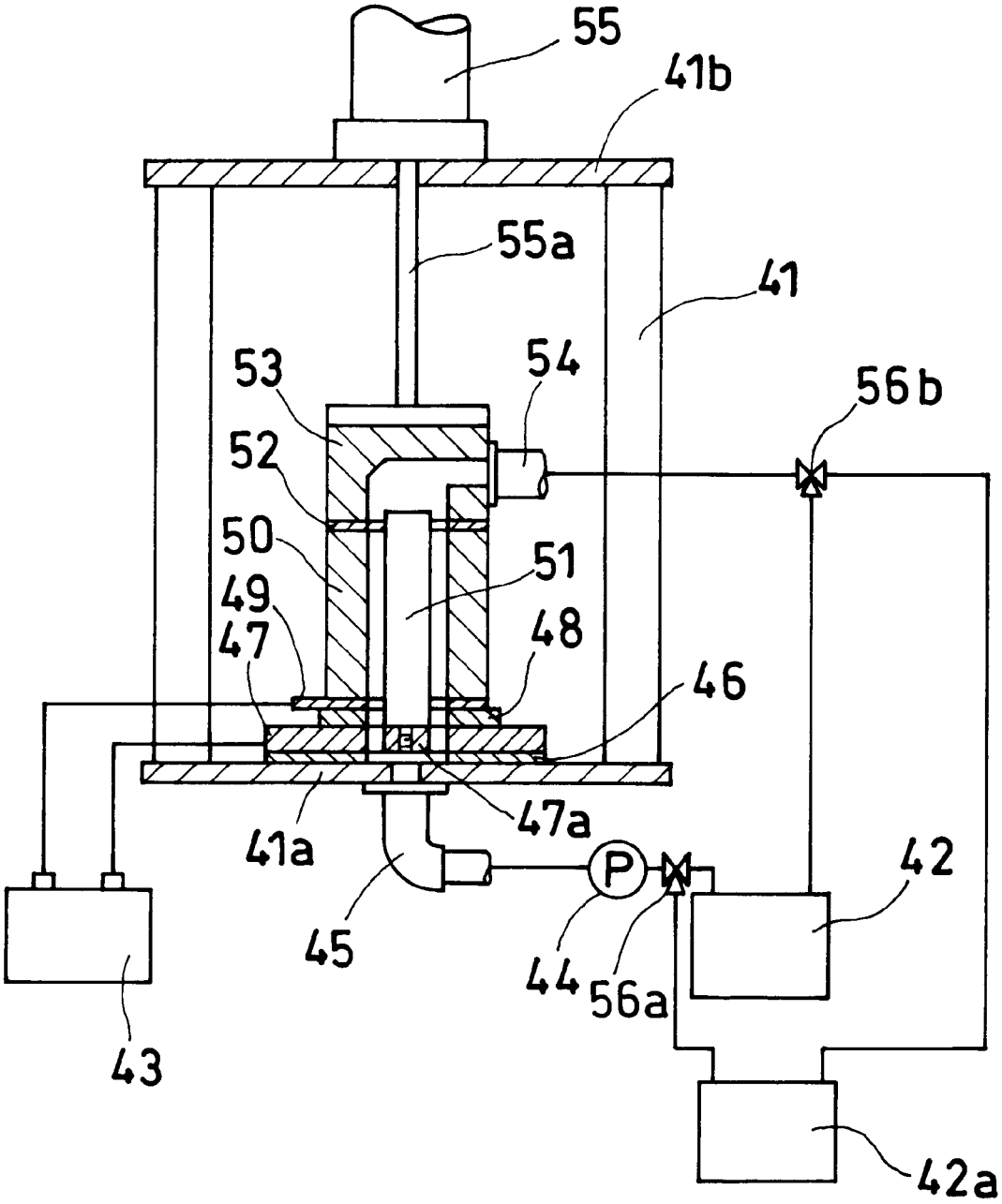
FIG. 5 shows one example of an apparatus for anodic electrolytic etching.
Figure 6:
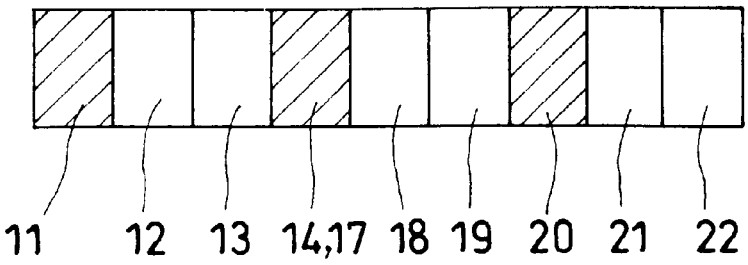
FIG. 6 shows one example of a fabrication line according to the plating method of the present invention.

In particular, when both the electrolytic etching treatment and the anodic oxidation treatment use phosphoric acid, tubings and apparatus can be used in common for both the treatments. Members indicated by reference numerals in FIG. 5 are almost all the same as those in FIG. 4, and their explanations are omitted. In FIG. 5, phosphoric acid for the electrolytic etching is placed in a liquid vessel 42, and phosphoric acid for the anodic oxidation is placed in a liquid vessel 42*a.* These liquids are consecutively flowed with three-way valves 56*a* and 56*b,* and the cylinder is continuously treated. In this case, it is sufficient to switch from one liquid to the other in a state where the cylinder as a work is fixed, it is therefore not necessary to convey the work, and a series of treatments are efficiently carried out. In this case, further, the plating line can be decreased in the number of steps as shown in FIG. 6. That is, as compared with the line shown in FIG. 2, the washing-with-water vessels 15 and 16 can be omitted, and one vessel can be used as the electrolytic etching vessel 14 and the anodic oxidation vessel 17 in one apparatus.

The apparatus for plating the cylinder has almost the same structure as that of the above apparatus for the electrolytic etching, and the apparatus for plating the cylinder is as shown in FIG. 5 except that the cylinder (work) 50 is used as a cathode, that the electrode 51 is used as an anode and that a different electrolyte is used.

The outline of the apparatus for pre-treating and plating a cylinder block will be explained with reference to FIG. 7 hereinafter.

Figure 7:
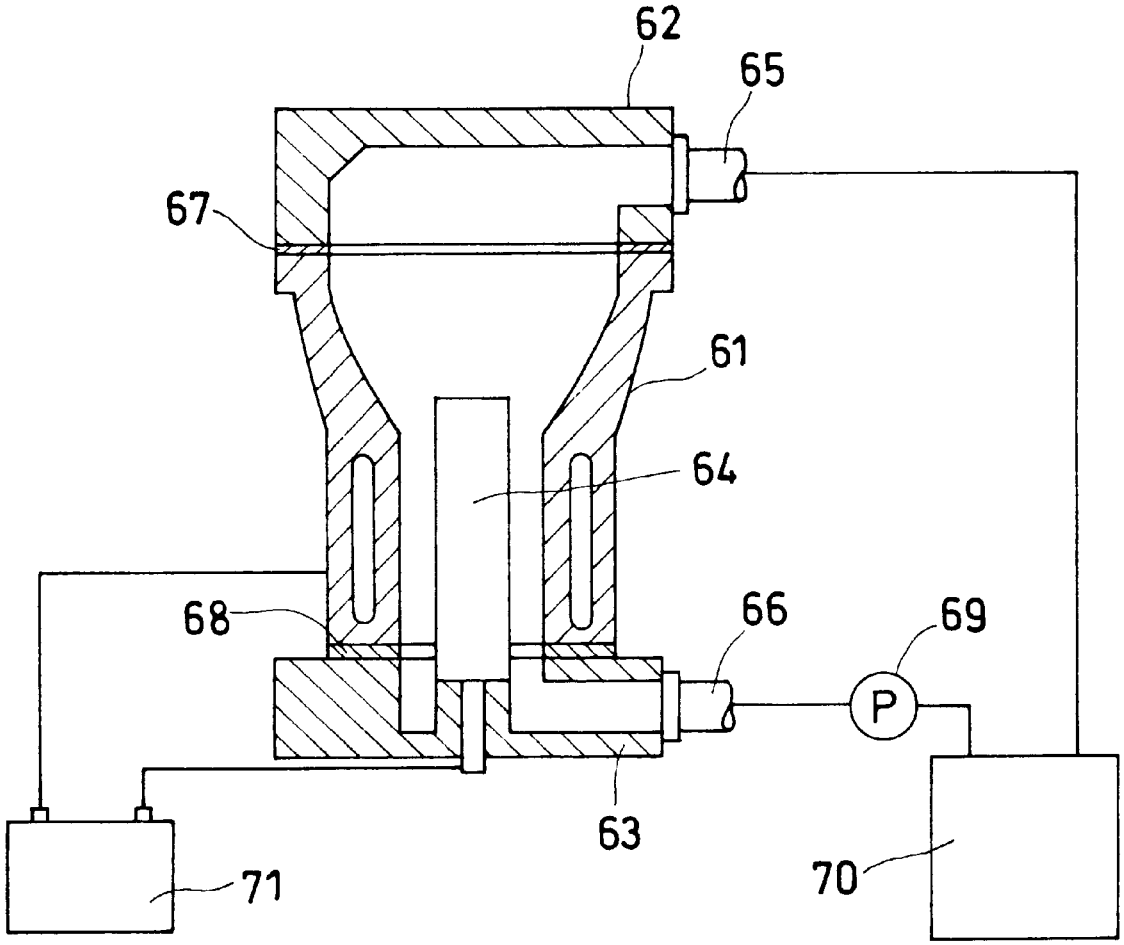
FIG. 7 shows one example of an apparatus for plating a cylinder block.

In FIG. 7, a cylinder block 61 is placed on a lower tool 63 through a lower packing 68, and the upper portion of the cylinder is sealed with an upper tool 62 and an upper packing 67. The cylinder block 61 is chucked with the tools 62 and 63 by a press method using an air cylinder or by fixing them with bolts. An electrolyte for the pretreatment and a plating liquid are sent from a treatment liquid tank 70 under pressure with a pump 69, flow in through a treatment liquid inlet 66, pass through the interior of the cylinder, pass through a treatment liquid outlet 65 disposed in the upper tool 62 and are discharged to the treatment liquid tank 70. An electrode 64 is fixed to the lower tool 63 so as to be positioned in the center of the cylinder, and is connected to a power source 71 together with the cylinder block 61. For the anodic electrolytic etching and the anodic oxidation treatment, electricity is applied such that the electrode 64 is minus and that the cylinder block 61 is plus. The plating is also carried out in a similar apparatus by connecting the electrode 64 to plus and the cylinder block 61 to minus. In the flow method in which the treatment liquid is flowed through only the interior of the cylinder as described above, masking, etc., are not necessary and the treatment of an unnecessary portion is obviated. Therefore, the treatment liquid has a long life, and the method is efficient, as compared with the method in which a work is immersed in a treatment liquid.

The cylinder block is generally produced by a low-pressure casting method using an AC4B material (Si content: 7 to 10%) or an AC4C material (Si content: 6.5 to 7.5%) or by a die casting method using an ADC12 material (Si content: 9.6 to 12%).

The method of pretreatment for plating, provided by the present invention, is advantageous in that it is excellent in safety since no mixed acids are used. The effect thereof is remarkably produced when a treatment liquid is circulated with the pump 69 as shown in FIG. 7. This point will be discussed in detail below.

In general, a cylinder block for a motor vehicle has a structure in which a crank case is connected to one end of a cylindrical portion, and in a multiple cylinder engine having a plurality of cylinders, one cylinder of the crank case is spaced from another with a partition wall. The cylinder block therefore does not have many structurally flat portions. It is therefore difficult to seal the opening portion of the cylinder, and the sealing is liable to be incomplete. However, the mixed acids are toxic, and its leakage is very dangerous. It is therefore required to prevent the leakage of the treatment liquid by sealing the opening portion of the cylinder. Further, materials for tubings, tools, pumps, etc., are required to be acid-resistant against the mixed acids having a high corrosiveness, and the cost of apparatus and equipment therefore increases. In contrast, the method of pretreatment for plating, provided by the present invention, does not use the mixed acids, and is therefore free of the above defects.

In an automatic plating line in which cylinder blocks are conveyed to each treatment tool and chucked with each tool, the number of times of chucking is large when the number of steps is large as in the double zincate conversion method. Therefore, the liquid leakage caused by incomplete sealing is liable to take place and there is an increased risk. In contrast, the method of pretreatment for plating, provided by the present invention, is preferred in view of safety, since it includes smaller number of steps and has a decreased risk of incomplete sealing.

Further, when phosphoric acid is used as an electrolyte for the electrolytic etching and as an electrolyte for the anodic oxidation treatment, not only the washing-with-water step between the electrolytic etching and the anodic oxidation treatment can be omitted, but also it is not required to convey a cylinder block, so that the chucking is required only once. The risk of the liquid leakage is therefore decreased. Further, the number of steps in the plating line is decreased allowing for a more efficient process of increased productivity.

The present invention will be explained with reference to Examples and Comparative Examples hereinafter.

EXAMPLE 1

"AC8A" (name according to JIS) which was an aluminum alloy containing silicon was neutrally degreased with a water-soluble degreasing agent "NG30" (supplied by KIZAI Co.) at 45° C. for 10 minutes, and then washed with water. "AC8A" contained chemical components of 11.0 to 13.0% of Si, 0.8% of Fe, 0.8 to 1.3% of Cu, 0.15% of Mn, 0.7 to 1.3% of Mg, 0.15% of Zn, 0.8 to 1.5% of Ni, 0.20% of Ti, 0.05% of Pb, 0.05% of Sn, 0.10% of Cr and the rest of Al.

The degreased aluminum alloy was immersed in an electrolyte (200 g/L of a phosphoric acid aqueous solution, 80° C.), and electrolytically etched at a current density of 100 A/dm$^2$ for ten minutes. SUS304 was used as an insoluble electrode.

Electricity was applied to the electrolytically etched aluminum alloy at a current density of 5 A/dm$^2$ for 5 minutes under plating conditions of a pH of 4.0 and a temperature of 57±2° C., and further, electricity was applied thereto at a current density of 20 A/dm$^2$ for 30 minutes to plate it with Ni-P-SiC. The plating bath used in this case had a composition containing 535 ml/L of nickel sulfamate ($Ni(NH_2SO_3)_2.4H_2O$), 15 g/L of nickel chloride ($NiCl_2.6H_2O$), 45 g/L of boric acid ($H_3BO_3$), 3.2 g/L of saccharin sodium, 1.5 g/L of hypophosphorous acid and 40 g/L of silicon carbide (SiC).

Figure 8:
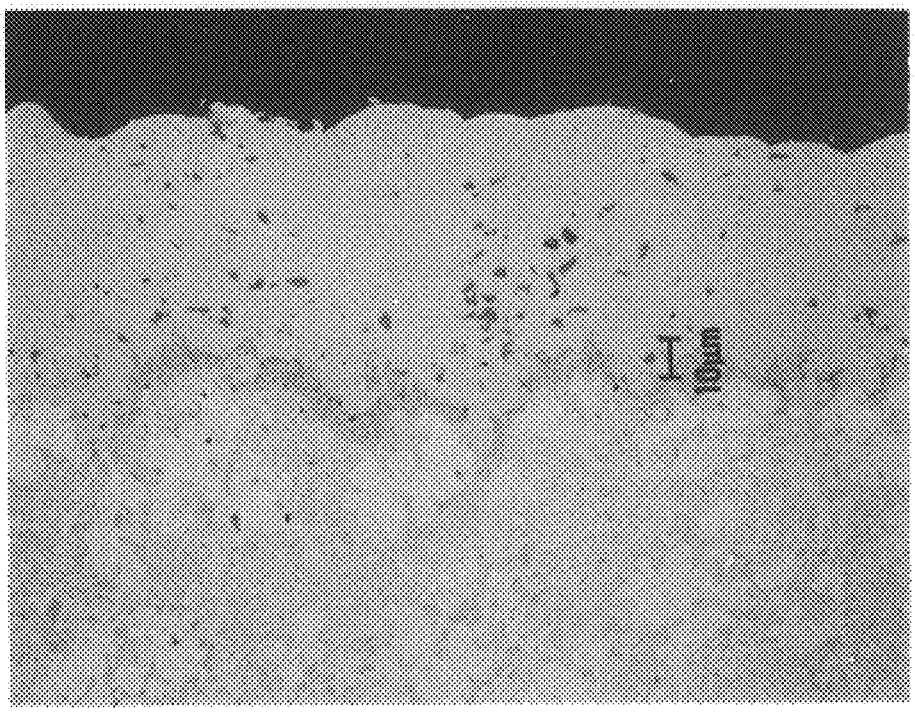
FIG. 8 is a microscopic photograph (magnification: 400 diameters) of cross section of a plating-coated aluminum alloy obtained by the method of the present invention.

FIG. 8 shows a microscopic photograph (magnification: 400 diameters) of cross section of the aluminum alloy coated by the plating. In FIG. 8, a white portion as a lower layer is the aluminum alloy containing silicon, a gray portion as an upper layer is a plating layer, and those which are sparsely present in the form of grains or bands from the lower layer to the bottom of the upper layer are of silicon. Those which are interspersed in the upper layer are SiC particles.

After the plating, an adhesion test was carried out in which a cutter blade was inserted in the interface between the coating formed by the plating and the aluminum alloy to see whether or not the coating was peelable.

COMPARATIVE EXAMPLE 1

As a pretreatment, the zincate conversion was carried out under the conditions shown in Table 1, and then the plating with Ni-P-SiC was carried out in a nickel sulfamate bath in the same manner as in Example 1. The same adhesion test as that in Example 1 was carried out.

COMPARATIVE EXAMPLE 2

As a pretreatment, the anodic oxidation was carried out under the conditions shown in Table 1, and then the plating with Ni-P-SiC was carried out in a nickel sulfamate bath in the same manner as in Example 1. The same adhesion test as that in Example 1 was carried out.

Figure 11:
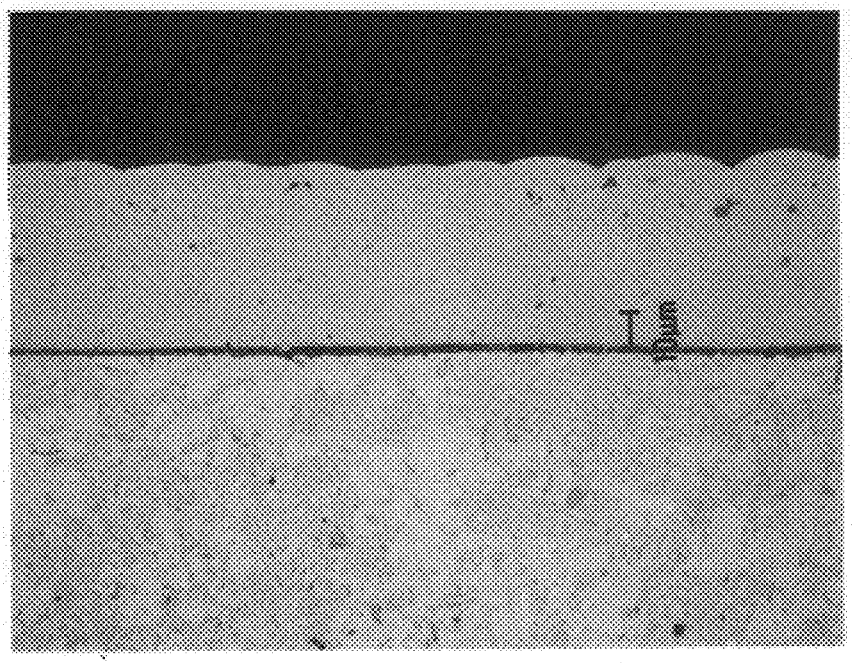
FIG. 11 is a microscopic photograph (magnification: 400 diameters) of a plating-coated aluminum alloy obtained by a conventional method (anodic oxidation method).

FIG. 11 shows a microscopic photograph (magnification: 400 diameters) of cross section of an aluminum alloy coated with the plating. In FIG. 11, a lower layer is an aluminum alloy, an intermediate layer (black) is an anodic oxide coating, and an upper layer is a coating formed by the plating.

Table 3 shows the results of the above adhesion tests and the number of steps of plating methods. The coating formed by the plating according to the method of the present invention (Example 1) did not peel and showed excellent adhesion. The coating obtained according to the zinc conversion method (Comparative Example 1) showed excellent adhesion, while the defect thereof is that the number of steps is large and that the treatment thereof takes a long period of time. The coating obtained according to the anodic oxidation method (Comparative Example 2) peeled in the form of small pieces and was so poor in adhesion.

TABLE 3

| | Example 1 | Comparative Example 1 | Comparative Example 2 |
|---|---|---|---|
| Adhesion | Excellent | Excellent | Peeled |
| Number of Steps | 5 | 15 | 11 |

EXAMPLES 2–5 AND COMPARATIVE EXAMPLE 3

Aluminum alloys having different silicon contents and morphologically different crystal states of silicon were used to carry out adhesion tests of coatings formed by plating. The conditions of the anodic electrolytic etching (pretreatment) and the plating were the same as those in Example 1.

The coatings formed by the plating were evaluated for adhesion by cutting out test pieces (40 mm×50 mm) and inserting a cutter blade in interfaces between the coatings formed by the plating and the aluminum alloys to peel the coatings.

As test pieces, there were used five kinds of aluminum alloys as shown in Table 4, i.e., A5052 (Comparative Example 3), AC4D (Example 2), ADC12 (Example 3), A4032 (Example 4) and an original aluminum alloy (Example 5) each of which was different from every other one in silicon content and the morphology of silicon crystal. The names of the aluminum alloys other than the original were according to names in the JIS standard. As shown in Table 4, when the silicon content was 0.25%, the adhesion was poor since the amount of silicon which constituted an anchor was small. The aluminum alloys having a silicon content of 4.5% or more showed good or excellent adhesion.

Figure 9:
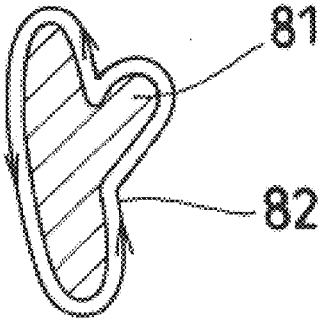
FIG. 9 shows one example of a peripheral length of silicon.
Figure 10:
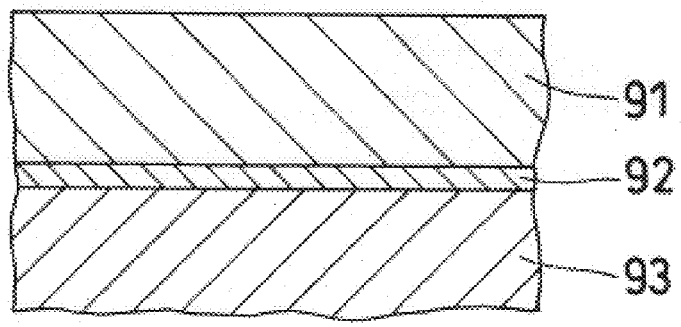
FIG. 10 is a schematic view of cross section of a plating-coated aluminum alloy obtained by a conventional method (anodic oxidation method).

Further, the morphology of silicon crystal affects the adhesion, and aluminum alloys having silicon crystals which form a fine and concavo-convex shape are preferred. For evaluating the degree of the concavo-convex shape, silicon crystals were measured for peripheral lengths as shown in FIG. 9. In FIG. 9, the length measured along the perimeter of a silicon crystal 81 refers to a peripheral length 82. In the measurement, the sectioned surface of each aluminum alloy was specularly polished, and then, while the polished surfaces were observed through a microscope (magnification: 400 diameters), the silicon crystals were measured for peripheral lengths with an image processing/analyzing apparatus (Ruzex IID, supplied by Nicole Co.). Table 4 shows the total of peripheral lengths of silicon crystals contained in each cross section having an area of 100 μm×100 μm ($10^4$ μm$^2$). Table 4 shows that, for improving the adhesion, the peripheral length is required to be, preferably, at least 500 μm/$10^4$ μm$^2$, more preferably at least 3,000 μm/$10^4$ μm$^2$.

TABLE 4

| | Silicon Content (%) | Per $10^4$ μm$^2$ of aluminum alloy: Number of Si grains | Average peripheral length/ of Si grains (μm) | Total length of Si grains (μm) | Adhesion of coating formed by plating | aluminum alloy |
|---|---|---|---|---|---|---|
| CEx. 3 | 0.25 | 36 | 6.41 | 233 | X | A5052 |
| Ex. 2 | 4.5 | 27 | 28.75 | 764 | ○ | AC4D |

TABLE 4-continued

| | Silicon Content (%) | Per $10^4$ $\mu m^2$ of aluminum alloy: Number of Si grains | Average peripheral length/ of Si grains ($\mu$m) | Total length of Si grains ($\mu$m) | Adhesion of coating formed by plating | aluminum alloy |
|---|---|---|---|---|---|---|
| Ex. 3 | 9.6 | 183 | 19.82 | 3,532 | ⊙ | ADC12 |
| Ex. 4 | 11.0 | 227 | 15.49 | 3,356 | ⊙ | A4032 |
| Ex. 5 | 17.0 | 70 | 36.37 | 2,530 | ○ | Original |

Ex. = Example, CEx. = Comparative Example
⊙ Excellent
○ Good
Δ Poor
X Very poor

Generally, a silicon crystal in an aluminum alloy is liable to be morphologically affected by a cooling rate. As the cooling rate increases, the silicon crystal tends to be finer, and as it is gradually cooled, the silicon crystal tends to be coarser. An aluminum alloy is produced by a sand mold casting method or a die casting method. The die casting method uses a die and therefore performs good heat conductivity, and it is known that, since the cooling rate in the die casting method is high, a fine silicon crystal is formed. However, the present invention shall not be limited to the die casting method. Regardless of the production method, the present invention can be applied to an aluminum alloy having a silicon content of at least 4.5% or an aluminum alloy containing silicon crystals of which the peripheral length is at least 500 $\mu m/10^4$ $\mu m^2$.

EXAMPLES 6–8 AND COMPARATIVE EXAMPLES 4–5

Various aluminum alloys (Examples 6 to 8) shown in Table 5 were plated under the same conditions as those in Example 1. The plated alloys were tested for adhesion in the same manner as in Example 1. Further, ADC10 was used as an aluminum alloy, and the ADC10 was plated according to the zincate conversion method (Comparative Example 4) or the anodization method (Comparative Example 5). Table 5 shows the results.

TABLE 5

| | | Si concentration (%) | Adhesion |
|---|---|---|---|
| Ex. 6 | AC4C | 6.5–7.5 | ⊙ |
| Ex. 7 | AC8A | about 17 | ⊙ |
| Ex. 8 | ADC10 | 7.5–9.5 | ⊙ |
| CEx. 4 | ADC10 | 7.5–9.5 | X |
| CEx. 5 | ADC10 | 7.5–9.5 | X |

Ex. = Example, CEx. = Comparative Example
⊙ Excellent
○ Good
Δ Poor
X Very poor

Table 6 shows compositions of the aluminum alloys used in the above Examples and Comparative Examples.

TABLE 6

| Kind (name according to JIS) | Chemical Composition (%): Si | Fe | Cu | Mn | Mg | Zn | Ni | Ti | Pb | Sn | Cr | Al |
|---|---|---|---|---|---|---|---|---|---|---|---|---|
| A5052 | 0.25 | 0.40 | 0.10 | 0.10 | 2.2–2.8 | 0.10 | — | — | — | — | 0.15–0.35 | the rest |
| AC4D | 4.5–5.5 | 0.6 | 1.0–1.5 | 0.50 | 0.40–0.6 | 0.30 | 0.20 | 0.20 | 0.10 | 0.05 | 0.15 | " |
| ADC12 | 9.6–12.0 | 1.3 | 1.5–3.5 | 0.5 | 0.3 | 1.0 | 0.5 | — | — | 0.3 | — | " |
| A4032 | 11.0–13.5 | 1.0 | 0.5–1.3 | — | 0.8–1.3 | 0.25 | — | — | — | — | 0.10 | " |
| Original | 16.5–17.5 | 0.8 | 0.8–1.3 | 0.15 | 0.7–1.3 | 0.15 | 0.8–1.5 | 0.20 | 0.05 | 0.05 | 0.10 | " |
| AC4C | 6.5–7.5 | 0.55 | 0.25 | 0.35 | 0.25–0.45 | 0.35 | 0.10 | 0.20 | 0.10 | 0.05 | 0.10 | " |
| AC8A | 11.0–13.0 | 0.8 | 0.8–1.3 | 0.15 | 0.7–1.3 | 0.15 | 0.8–1.5 | 0.20 | 0.05 | 0.05 | 0.10 | " |
| ADC10 | 7.5–9.5 | 1.3 | 2.4–4.0 | 0.5 | 0.3 | 1.0 | 0.5 | — | — | 0.3 | — | " |

EXAMPLE 9 and COMPARATIVE EXAMPLE 6

Aluminum alloys containing silicon, AC4B (Si 7 to 10%), AC4C (Si 6.5 to 7.5%) and ADC12 (Si 9.6 to 12.0%), were pre-treated according to the pretreatment method of the present invention or the zincate conversion method as prior art, and these aluminum alloys were plated with Ni-P-SiC in a nickel sulfamate bath. The resultant plated aluminum alloys were compared concerning adhesion. Table 7 shows conditions of the pretreatment method of the present invention, and Table 8 shows conditions of the zincate conversion method. Table 9 shows plating conditions common to these two methods. The coatings formed by the plating were evaluated for adhesion by inserting a cutter blade in the interfaces between the coatings formed by the plating and the aluminum alloys to peel the coatings. Table 10 shows the results.

TABLE 7

| | |
|---|---|
| Degreasing | NG30 (supplied by KIZAI Co.) 45° C., 10 minutes |
| Anodic electrolytic etching | Electrolyte: phosphoric acid 309 g/L, 70° C., 100 A/dm$^2$, 2 minutes |
| Anodic oxidation 2 minutes | Electrolyte: phosphoric acid 75 g/L; 50° C., 15 A/dm$^2$ |

TABLE 8

| Step | Conditions |
|---|---|
| Neutral degreasing | NG30 (supplied by KIZAI Co.), 45° C., 10 minutes |
| Washing with water | |
| Alkali degreasing | SZ Cleaner (supplied by KIZAI Co.), 70° C., 5 minutes |
| Washing with water | |
| Alkali etching | $P_3T_{651}$-7 (supplied by Henkel-Hakusuisha Co.), 65° C., 2 minutes |
| Washing with water | |
| Mixed acids | Nitric acid:fluoric acid = 9:1, 25° C., 1 minute |
| Washing with water | |
| lst Zincate conversion | SZ-II (supplied by KIZAI Co.), 20° C., 30 seconds |
| Washing with water | |
| Immersion in acid | Nitric acid, 25° C., 15 seconds |
| Washing with water | |
| 2nd Zincate conversion | SZ-II (supplied by KIZAI Co.), 20° C., 30 seconds |
| Washing with water | |
| Plating | |

TABLE 9

| | | |
|---|---|---|
| Bath composition | Nickel sulfamate: | 535 ml/l |
| | Nickel chloride: | 15 g/l |
| | Boric acid: | 45 g/l |
| | Saccharin sodium: | 3.2 g/l |
| | Hypophosphrous acid: | 1.5 g/l |
| | SiC: | 40 g/l |
| Electric application conditions | 5 A/dm$^2$ × 5 minutes, 20 A/dm$^2$ × 30 minutes | |
| Temperature | 57° C. | |
| pH | 4.0 | |

TABLE 10

| | AC4B | AC4C | ADC12 |
|---|---|---|---|
| Pretreatment method of the present invention | ○ | ○ | ○ |
| Zincate conversion method | ○ | ○ | X |

○: Good, X: Poor

Table 10 shows that all the aluminum alloys pre-treated according to the pretreatment method of the present invention showed good adhesion. The zincate conversion method failed to impart ADC12 with sufficient adhesion.

In the following Examples 10 to 28 and Comparative Examples 7 to 18, coatings formed by plating was evaluated for adhesion by changing kinds, concentrations and temperatures of an electrolyte for plating. An aluminum alloy (test piece) was treated in the order of degreasing, anodic electrolytic etching and plating, and then the coating formed by the plating was evaluated for adhesion. A 50×60×1.2 mm plate formed of ADC12 was used as a test piece. The degreasing was carried out with a NG30 (supplied by KIZAI Co.) as degreasing agent at a temperature of 40 to 50° C. for 5 to 10 minutes. The aluminum alloy was plated with Ni-P-SiC by applying electricity at a current density of 5 A/dm$^2$ for 5 minutes and further applying electricity at a current density of 20 A/dm$^2$ for 30 minutes under plating bath conditions of a pH of 4.0 and a temperature of 57±2° C. The plating bath had a composition containing 535 ml/L of nickel sulfamate, 15 g/L of nickel chloride, 45 g/L of boric acid, 3.2 g of saccharin sodium, 1.5 g/L of hypophosphorous acid and 40 g/L of silicon carbide.

EXAMPLES 10–16 AND COMPARATIVE EXAMPLES 7 to 10

Examples 10 to 16 and Comparative Examples 7 to 10 used phosphoric acid as an electrolyte. The adhesion was evaluated by changing phosphoric acid concentrations with maintaining a constant temperature, or was evaluated by changing temperatures with maintaining a constant phosphoric acid concentration.

The anodic electrolytic etching was carried out at an anode current density of 100 A/dm$^2$ under conditions shown in Tables 11 and 12, and then, the plating was carried out. Coatings formed by the plaiting were evaluated for adhesion by a peel test using a cutter blade.

In the evaluation of the adhesion, the treated test pieces were evaluated for adhesion by cutting them and inserting a cutter blade in interfaces between the coatings formed by the plating and the aluminum alloy matrices to confirm whether or not the coatings were peeled.

TABLE 11

| | CEx. 7 | Ex. 10 | Ex. 11 | Ex. 12 | Ex. 13 |
|---|---|---|---|---|---|
| Phosphoric acid (g/L) | 25 | 50 | 300 | 500 | 900 |
| Temperature (° C.) | 80 | 80 | 80 | 80 | 80 |
| Adhesion | X | ○ | ○ | ○ | ○ |

CEx. = Comparative Example, Ex. = Example
○: Good adhesion
X: Relatively poor adhesion

TABLE 12

| | CEx. 8 | CEx. 9 | CEx. 10 | Ex. 14 | Ex. 15 | Ex. 16 |
|---|---|---|---|---|---|---|
| Phosphoric acid (g/L) | 300 | 300 | 300 | 300 | 300 | 300 |
| Temperature (° C.) | 0 | 5 | 40 | 60 | 80 | 95 |
| Adhesion | X | X | X | ○ | ○ | ○ |

CEx. = Comparative Example, Ex. = Example
○: Good adhesion
X: Relatively poor adhesion

EXAMPLES 17–21 AND COMPARATIVE EXAMPLES 11–12

Examples 17 to 21 and Comparative Examples 11 to 12 used sulfamic acid as an electrolyte. The adhesion was evaluated by changing sulfamic acid concentrations with maintaining a constant temperature, or was evaluated by changing temperatures with maintaining a constant sulfamic acid concentration.

The anodic electrolytic etching was carried out at an anode current density of 100 A/dm$^2$ under conditions shown in Tables 13 and 14, and then, the plating was carried out. Coatings formed by the plaiting were evaluated for adhesion by a peel test using a cutter blade.

TABLE 13

| | CEx. 11 | Ex. 17 | Ex. 18 | Ex. 19 |
|---|---|---|---|---|
| Sulfamic acid (g/L) | 50 | 100 | 200 | 600 |
| Temperature (° C.) | 80 | 80 | 80 | 80 |
| Adhesion | X | ○ | ○ | ○ |

CEx. = Comparative Example, Ex. = Example

TABLE 13-continued

| | CEx. 11 | Ex. 17 | Ex. 18 | Ex. 19 |
|---|---|---|---|---|
| ○: Good adhesion | | | | |
| X: Relatively poor Adhesion | | | | |

TABLE 14

| | CEx. 12 | Ex. 20 | Ex. 21 |
|---|---|---|---|
| Sulfamic acid (g/L) | 200 | 200 | 200 |
| Temperature (° C.) | 60 | 70 | 90 |
| Adhesion | X | ○ | ○ |

CEx. = Comparative Example, Ex. = Example
○: Good adhesion
X: Relatively poor Adhesion

EXAMPLES 22–26 AND COMPARATIVE EXAMPLES 13–17

Examples 22 to 26 and Comparative Examples 13 to 17 used sulfuric acid as an electrolyte. The adhesion was evaluated by changing sulfuric acid concentrations with maintaining a constant temperature, or was evaluated by changing temperatures with maintaining a constant sulfuric acid concentration.

The anodic electrolytic etching was carried out at an anode current density of 100 A/dm$^2$ under conditions shown in Tables 15 and 16, and then, the plating was carried out. Coatings formed by the plaiting were evaluated for adhesion by a peel test using a cutter blade.

TABLE 15

| | CEx.13 | CEx.14 | Ex.22 | Ex.23 | Ex.24 |
|---|---|---|---|---|---|
| Sulfuric acid (g/L) | 10 | 50 | 100 | 300 | 600 |
| Temperature(° C.) | 70 | 70 | 70 | 70 | 70 |
| Adhesion | X | X | ○ | ○ | ○ |

CEx. = Comparative Example, Ex. = Example
○: Good adhesion
X: Relatively poor Adhesion

TABLE 16

| | CEx.15 | CEx.16 | CEx.17 | Ex.25 | Ex.26 |
|---|---|---|---|---|---|
| Sulfuric acid (g/L) | 300 | 300 | 300 | 300 | 300 |
| Temperature (° C.) | 0 | 10 | 40 | 60 | 90 |
| Adhesion | X | X | X | ○ | ○ |

CEx. = Comparative Example, Ex. = Example
○: Good adhesion
X: Relatively poor Adhesion

EXAMPLES27–28 AND COMPARATIVE EXAMPLE 18

Examples 27 and 28 and Comparative Example 18 used a mixture of phosphoric acid and sulfuric acid as an electrolyte. The adhesion was evaluated by changing temperatures with maintaining a constant concentration of the mixture.

The anodic electrolytic etching was carried out at an anode current density of 100 A/dm$^2$ under conditions shown in Table 17, and then, the plating was carried out. Coatings formed by the plaiting were evaluated for adhesion by a peel test using a cutter blade.

TABLE 17

| | CEx. 18 | Ex. 27 | Ex. 28 |
|---|---|---|---|
| Phosphoric acid (g/L) | 500 | 500 | 500 |
| Sulfuric acid (g/L) | 200 | 200 | 200 |
| Temperature (° C.) | 40 | 60 | 80 |
| Adhesion | X | ○ | ○ |

CEx. = Comparative Example, Ex. = Example
○: Good adhesion
X: Relatively poor Adhesion

We claim:

1. A pretreatment method for plating an aluminum alloy, which comprises the step of carrying out anodic electrolytic etching of a silicon-containing aluminum alloy to protrude silicon from a surface of the aluminum alloy, wherein the anodic electrolytic etching is carried out by using the silicon-containing aluminum alloy as an anode.

2. The pretreatment method of claim 1, wherein the anodic electrolytic etching of the silicon-containing aluminum alloy is carried out to form a concavo-convex shape on the surface of the aluminum alloy.

3. The pretreatment method of claim 1, wherein the anodic electrolytic etching is carried out by using the silicon-containing aluminum alloy as an anode, using an insoluble electrode as a cathode and applying electricity in an electrolyte.

4. The pretreatment method of claim 3, wherein the electrolyte is at least one selected from phosphoric acid, sulfamic acid or sulfuric acid.

5. The pretreatment method of claim 1, wherein the method comprises the step of carrying out anodic oxidation of the aluminum alloy on its surface after the anodic electrolytic etching, to form an aluminum alloy oxide layer.

6. The pretreatment method of claim 5, wherein the anodic electrolytic etching and the anodic oxidation are carried out by using the silicon-containing aluminum alloy as an anode, using an insoluble electrode as a cathode and applying electricity in an electrolyte.

7. The pretreatment method of claim 6, wherein the electrolyte is at least one selected from phosphoric acid, sulfamic acid or sulfuric acid.

8. A method of plating an aluminum alloy, which comprises the steps of carrying out anodic electrolytic etching of a silicon-containing aluminum alloy to protrude silicon from a surface of the aluminum alloy and to form a concavo-convex shape on the surface of the aluminum alloy, and plating the aluminum alloy, wherein the anodic electrolytic etching is carried out by using the silicon-containing aluminum alloy as an anode.

9. The method of claim 8, wherein the anodic electrolytic etching is carried out by using the silicon-containing aluminum alloy as an anode, using an insoluble electrode as a cathode and applying electricity in an electrolyte.

10. The method of claim 9, wherein the electrolyte for the anodic electrolytic etching is at least one selected from phosphoric acid, sulfamic acid or sulfuric acid.

11. The method of claim 8, wherein the method further comprises the step of carrying out anodic oxidation of the aluminum alloy on its surface from which silicon is protruding, before the step of plating.

12. The method of claim 11, wherein the anodic electrolytic etching and the anodic oxidation are carried out by using the silicon-containing aluminum alloy as an anode, using an insoluble electrode as a cathode and applying electricity in an electrolyte.

13. The method of claim 12, wherein the electrolyte for the anodic electrolytic etching and the anodic oxidation is at least one selected from phosphoric acid, sulfamic acid or sulfuric acid.

14. The method of claim 8, wherein the step of plating uses Ni-P, Ni-SiC or Ni-P-SiC for plating the aluminum alloy, and the aluminum alloy is selected from an AC material or an ADC material.

15. A treatment line for plating an aluminum alloy, which comprises a degreasing portion, an electrolytic etching portion, a plating portion, and an anodic oxidation portion.

16. The treatment line of claim 15, wherein the plating portion uses any one selected from Ni-P, Ni-SiC and Ni-P-SiC for plating an aluminum alloy, and the aluminum alloy is an AC material or an ADC material.

* * * * *

UNITED STATES PATENT AND TRADEMARK OFFICE

CERTIFICATE OF CORRECTION

PATENT NO. : 5,980,722
DATED : November 9, 1999
INVENTOR(S) : Kuroda et al.

It is certified that error appears in the above-identified patent and that said Letters Patent is hereby corrected as shown below:

Column 3,
Line 62, "comprises" should read -- comprise --.

Signed and Sealed this

Second Day of October, 2001

*Attest:*

Nicholas P. Godici

NICHOLAS P. GODICI
*Acting Director of the United States Patent and Trademark Office*

*Attesting Officer*